US005772849A

United States Patent [19]

Meschenmoser

[11] Patent Number: 5,772,849

[45] Date of Patent: Jun. 30, 1998

[54] PRESS

[75] Inventor: Andreas Meschenmoser, Horgenzell, Germany

[73] Assignee: Voith Sulzer Papiermaschinen GmbH, Heidenheim, Germany

[21] Appl. No.: 650,126

[22] Filed: May 17, 1996

[51] Int. Cl.[6] ..... D21F 3/02

[52] U.S. Cl. ..... 162/360.2; 162/358.2; 162/358.3

[58] Field of Search ..... 162/358.1, 358.2, 162/358.3, 360.2

[56] References Cited

U.S. PATENT DOCUMENTS

| | | | |
|---|---|---|---|
| 3,215,592 | 11/1965 | Justus et al. | 162/358.1 |
| 3,293,121 | 12/1966 | Martin . | |
| 3,325,351 | 6/1967 | Orton, Jr. | 162/358.1 |
| 3,556,940 | 1/1971 | Cronin | 162/358.2 |
| 4,915,790 | 4/1990 | Dahl | 162/360.2 |
| 5,232,555 | 8/1993 | Daunais | 162/193 |

FOREIGN PATENT DOCUMENTS

| | | | |
|---|---|---|---|
| 0400843 A2 | 12/1990 | European Pat. Off. . | |
| 400843 | 12/1990 | European Pat. Off. | 162/358.2 |
| 2195723 | 3/1974 | France . | |
| 2381127 | 9/1978 | France . | |
| 2529922 | 1/1984 | France . | |
| 3604522 A1 | 9/1986 | Germany . | |
| 3708191 A1 | 9/1988 | Germany . | |
| 4112355 A1 | 10/1992 | Germany . | |
| 4443875 A1 | 6/1996 | Germany . | |

*Primary Examiner*—Karen M. Hastings
*Attorney, Agent, or Firm*—Townsend and Townsend and Crew LLP

[57] ABSTRACT

The invention relates to a press for the dewatering of fiber material webs with two press elements, the pressing surfaces of which can be pressed towards one another while forming a press gap, with the fiber material web being guided through the press gap together with at least one dewatering band extending between the fiber material web and in each case one of the press elements. Each dewatering band is separated at the press gap outlet from the fiber material web and is guided at at least one side of the fiber material web in a section following the press gap over a predeterminable angular region of the respectively associated press element. A short suction zone can be variably designed in all embodiments so that a reverse moistening of the fiber material web through the dewatering band after departing from the press gap is at least partly prevented and a guide roll for the fiber material web following the press gap can be arranged as close as possible to the press gap.

16 Claims, 5 Drawing Sheets

PRESS

FIELDS OF THE INVENTION

The invention relates to a press for the dewatering of fiber material webs comprising two press elements, the pressing surfaces of which can be pressed towards one another while forming a press gap, wherein the fiber material web together with at least one dewatering band extending between the fiber material web and in each case one of the press elements is guided through the press gap.

BACKGROUND OF THE INVENTION

A press of this kind is known from DE-OS 41 12 355. In this press the fiber material web to be dewatered is guided between two dewatering bands through the press gap, with the fiber material web remaining in contact with at least one dewatering band in a section which follows the press gap. This admittedly has the advantage that the fiber material web is guided in this section by the relevant dewatering band, which can be of advantage in particular at high speeds to avoid web tearing of web fluttering. However, this can also lead to reverse moistening or wetting of the fiber material web, starting from the dewatering band.

PRINCIPAL OBJECT OF THE INVENTION

The object of the invention is to provide a press of the initially named kind, which is suitable for high web running speeds and which prevents or at least strongly reduces reverse wetting of the fiber material web at the press gap outlet.

BRIEF DESCRIPTION OF THE INVENTION

This object is satisfied in accordance with the invention essentially in that each dewatering band is separated from the fiber material web at the press gap outlet and is guided at least at one side of the fiber material web in a section following the press gap over a predeterminable angular range at the respectively associated press element, so that a re-moistening of the fiber material web through the dewatering band after leaving the press gap is at least partially prevented, and a guide roll for the fiber material web following the press gap can be arranged as close as possible to the press gap.

Through the immediate leading away of the dewatering bands from the fiber material web at the press gap outlet a reverse moistening of the fiber material web is substantially reduced. Moreover, the guide roll for the fiber material web and/or a support band in the form of a felt or screen, which belongs to a subsequent unit, can be arranged as close as possible to the press gap, whereby the free draft, i.e. the section of the fiber material web which is not supported by any band up to the guide roll, is reduced so that, because of the extensive guidance of the fiber material web, the danger of web tearing and fluttering is reduced even at high speeds and the tension in the fiber material web can be kept smaller.

In other respects guide rolls for the dewatering bands of the press can be omitted in the region after the press gap, whereby one not only wins space but rather also a suction effect can be achieved with respect to the liquid which is to be led off from the fiber material web in the direction of the dewatering bands, which are rapidly moving away from it. In this way the degree of dewatering can be increased so that one can, for example, make do with only one such dewatering press within the paper making machine.

In accordance with a further embodiment provision is made that a separating screen having a preferably low liquid storage capacity is guided through the press gap on at least one side of the fiber material web between the dewatering band and the fiber material web, and in that the fiber material web is guided on the separating screen over a predeterminable path after leaving the press gap. In this way the danger of web tearing and web fluttering is reduced, even at high speeds.

The separating screen can be designed that it produces little marking since it is pressed against the fiber material web in the press gap. There are, however, also applications in which an impression is intentionally to be made on one side of the fiber web by the separating screen, for example with paper for packaging or sleeves. The separating screen can then have corresponding markings.

In accordance with a preferred embodiment provision is made that one of the press elements has a broad, in particular concavely shaped pressing surface for forming a press gap of a predetermined longitudinal extent with the other press element, and has a roll jacket consisting of a flexible material, which moves around a carrier and is supported on this via at least one support element; and in that the other press element has a pressing surface of complementary shape to the broad pressing surface and is preferably formed by a rotating cylindrical roll.

With a press element having a broad pressing surface a particularly rapid movement of the dewatering band, which runs around this press element, away from the fiber web, can be achieved as a result of the convex curvature of the roll jacket which adjoins the non-convex pressing surface, with it being advantageous when the dewatering band is guided at this press element at the press element, at least in a section following the press gap.

When the fiber material web is guided through the press gap between two dewatering bands the thickness elasticity and/or the absorbency of the dewatering band at the side of the fiber material web on which the fiber material web is to be moved along by the dewatering band or by the separating screen is greater than the absorbency of the dewatering band at the opposite side of the fiber material web. Through these measures it is ensured that the dewatering band on which the fiber material web is to stick is relaxed in a short section after the press gap, whereby a suction zone is formed in which further water is withdrawn from the fiber material web, which is running jointly with the dewatering band, or also from the separating screen. Thereafter this dewatering band should be led away from the fiber material web, or also from the separating screen, because of the threat of reverse moistening, and this can take place, at least in part, along the press element.

When using a separating screen this is preferably provided beneath the fiber material web so that a good guidance of the fiber material web to the next unit can be ensured through the separating screen.

Having regard to advantageous developments of the invention reference should be made to the subordinate claims and also to the subsequent description of embodiments of a press in accordance with the invention, with reference to the accompanying drawings.

DESCRIPTION OF THE PREFERRED EMBODIMENTS

Figure 1:
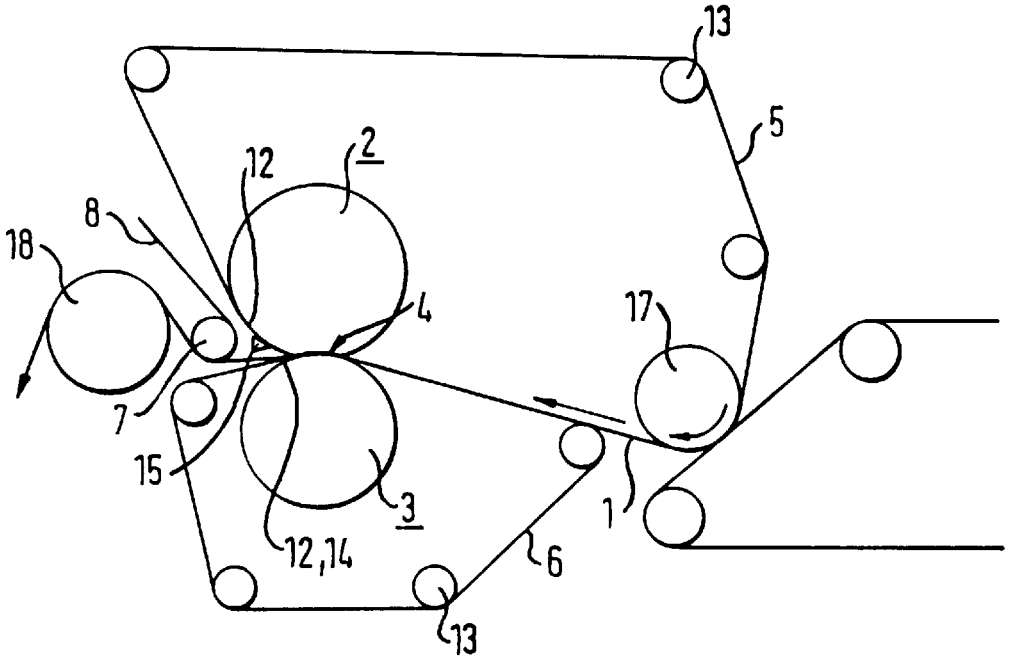
FIG. 1 is a schematic side view of an embodiment of a press in accordance with the invention.

In all Figures the press consists of two press elements 2, 3 arranged above one another, with their press surfaces being pressed towards one another, and with at least one dewatering band 5 or 6 respectively running through the press gap 4 alongside the fiber material web 1 between the fiber material web 1 and one of the press elements 2 and 3. The lower press element 3 is formed by a rotating cylindrical roll, which can be a conventional design, or a roll with controlled deflection.

The upper press element 2 can form a concave pressing surface with a roll jacket 10 consisting of a flexible material moving around a carrier (not shown) and being supported via at least one support element 11 on this carrier.

Other devices are, however, conceivable for the formation of the press gap 4. For example, both press elements 2, 3 can have a broad pressing surface and can each have a flexible jacket. In these embodiments the fiber material web 1 is taken off via a suction roll 17 from a preceding screen section and is transferred to the drying cylinder 18 of a subsequent drying section.

Furthermore, the embodiments have in common that the dewatering bands 5 and/or 6 are moved as quickly as possible away from the fiber material web 1 after leaving the press gap 4 and thereby move in a section 12 along the corresponding press element 2 or 3 respectively.

The dewatering bands 5, 6 are otherwise guided over felt guide rolls 13, as can be seen from the FIGS. 1 to 5, and can be used to guide the fiber material web 1 upstream of the press gap 4. The dewatering capacity of the longitudinal gap press can be considerably increased solely through the use of two dewatering bands 5 and 6. Moreover, the convex curvature of the upper press element 2 at the outlet of the concave pressing surface permits the direct movement of the dewatering band 5 away from the fiber material web 1 after the press gap 4 at the outlet of the concave pressing surface, at least in the section 12 along the press element 2, which prevents a reverse moisturising or wetting of the fiber material web starting from this dewatering band 5.

Figure 2:
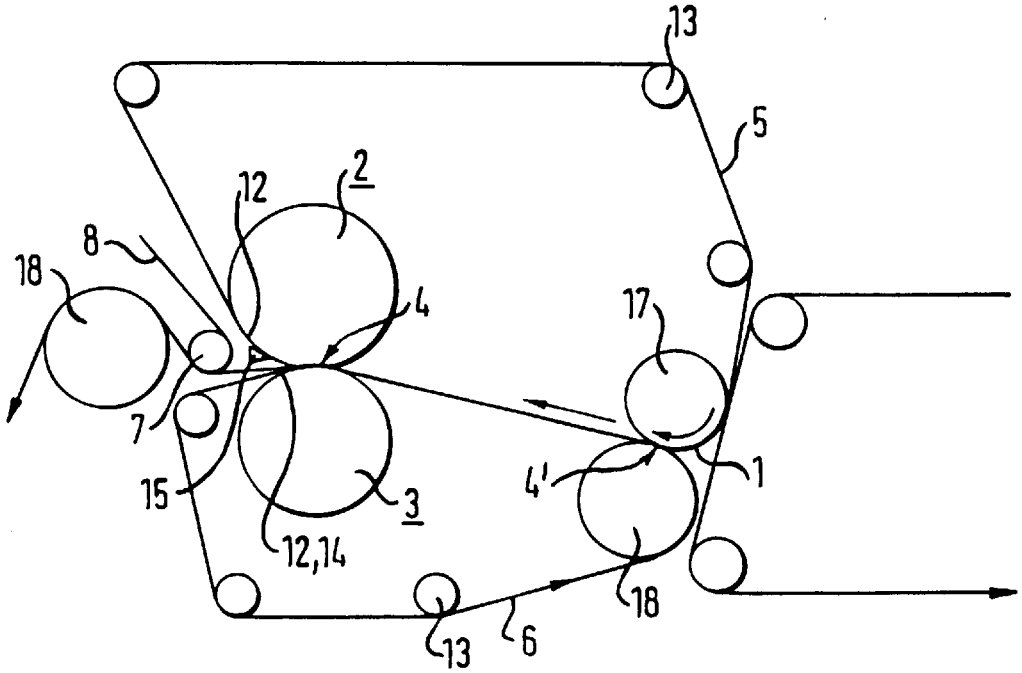
FIG. 2 is the press shown in FIG. 1 with a further press device preceding it.
Figure 3:
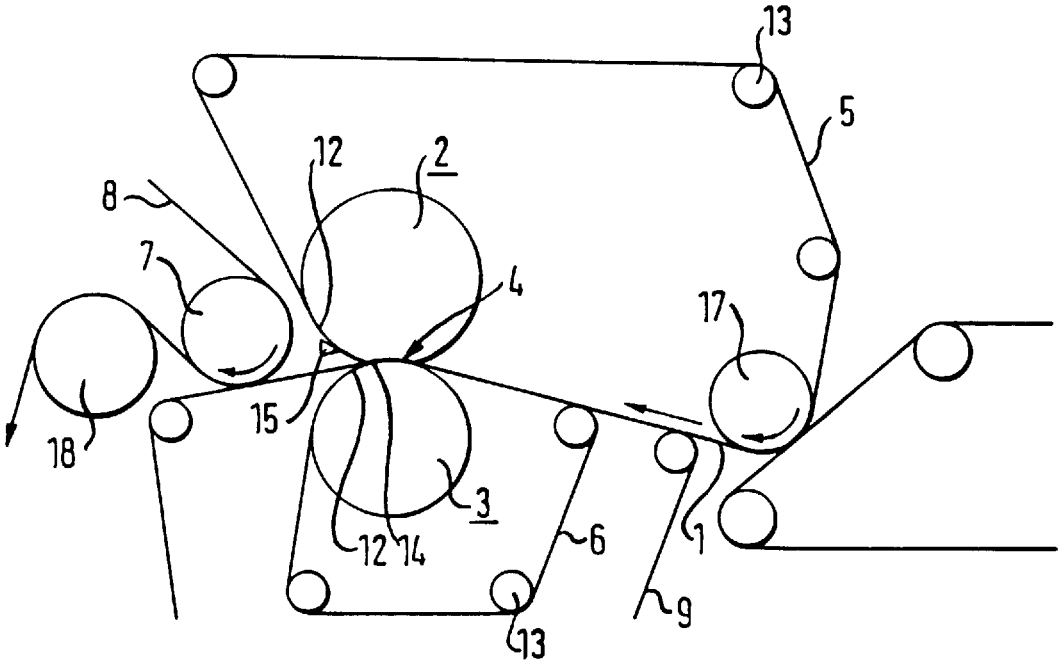
FIG. 3 is a side view of a further press in accordance with the invention.
Figure 4:
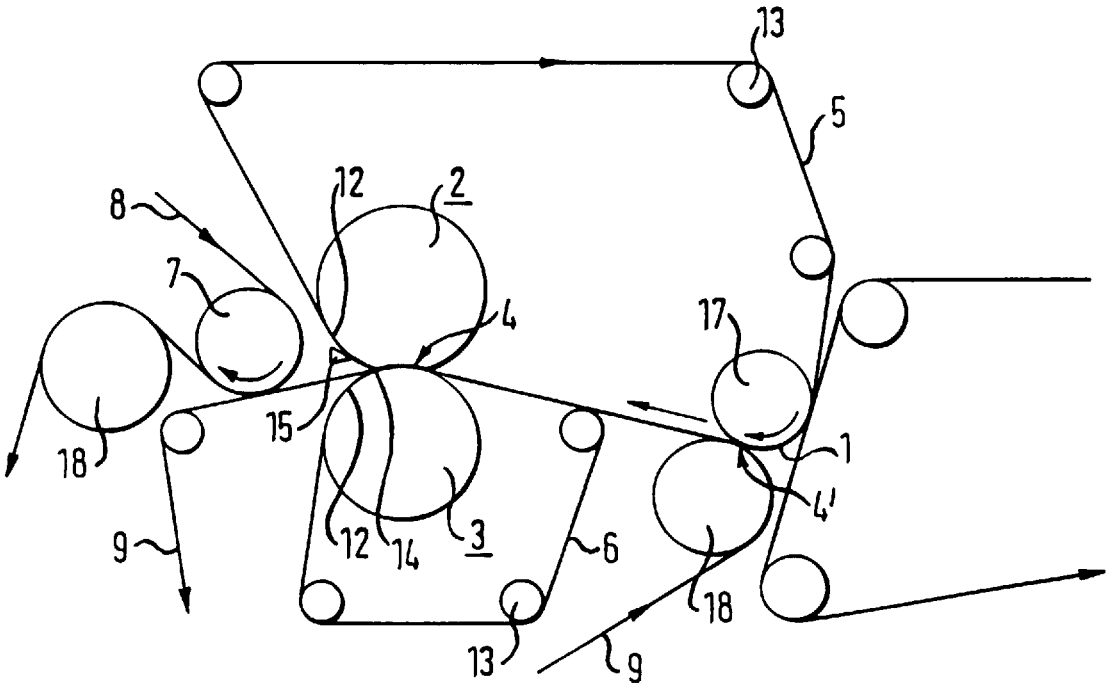
FIG. 4 is the press shown in FIG. 3 with a further press device preceding it.

In the presses shown in FIGS. 1 and 2 the fiber material web runs together with the lower dewatering band 6 over the cylindrical press element 3 after the press gap 4 approximately tangentially to the lower press element 3 in a suction zone 14, at the lower side of the fiber material web. This suction zone 14 is very short. This arrangement means that the fiber material web 1 is not bent to too great a degree and enables the entry of air to the upper side of the fiber material web tight up to the press gap 4 opposite to the direction of running, which reduces the danger of a depression forming there. In the suction zone 14 a relaxation of the lower dewatering band 6 arises, which is more elastic than the upper dewatering band 5, and thus liquid is sucked out of the fiber material web 1 into the lower dewatering band 6. Following the suction zone 14, the separation of the lower dewatering band 6 from the fiber material web 1 also takes place because of the threat of return moisturising, with the dewatering band 6 running, as shown in FIGS. 2, 3 and 4, in a section 12 at the press element 3, which extends beyond the suction zone 14.

The space won by guiding the dewatering bands 5 and 6 along the press elements 2 and 3 respectively is exploited in order to arrange a guide roll 7, which follows the press gap 4, as close as possible to the press gap 4. This shortens the free length of the fiber material web 1 between the press gap 4 and the guide roll 7, and counteracts the fluttering and tearing of the fiber material web 1. A support band 8 runs over the guide roll 7 to guide the fiber material web 1 to a drying cylinder 18 of a subsequent drying unit. The support band 8 is usually executed as a screen and can also be arranged on the other side of the fiber material web 1.

As shown in FIG. 2 a further press device 17, 18 with a press gap 4' can be inserted before the press 2, 3. In this case the dewatering bands 5, 6 run, together with the fiber material web 1 lying between them, in an advantageous manner also through the press gap 4' of this preceding press device, whereby the transport of the fiber material web 1 between the preceding press device 17, 18 and the press 2, 3 is made simple.

At least one of the press elements 17, 18 of the further press device is preferably a suction roll.

The FIGS. 3 to 6 shown longitudinal gap presses in which a separating screen 9 runs between the dewatering band of the lower pressing element 3 and the fiber material web 1. In this arrangement the separating screen 9 stands in contact with the fiber material web 1 at least in a section before and after the press gap 4 and thereby guides the fiber material web 1. This guidance of the fiber material web 1 can, for example, take place up to the next unit.

In this respect it is also possible for two separating screens 9, which enclose the fiber material web 1, to be guided through the press gap 4. Since the separating screen 9 is guided through the press gap 4 together with the fiber material web 1, it should, depending on the requirements on the end product, produce only low marking or pronounced marking, and should, in any event, have a very low liquid storage capacity because of the danger of reverse moistening after leaving the press gap 4.

Figure 6:
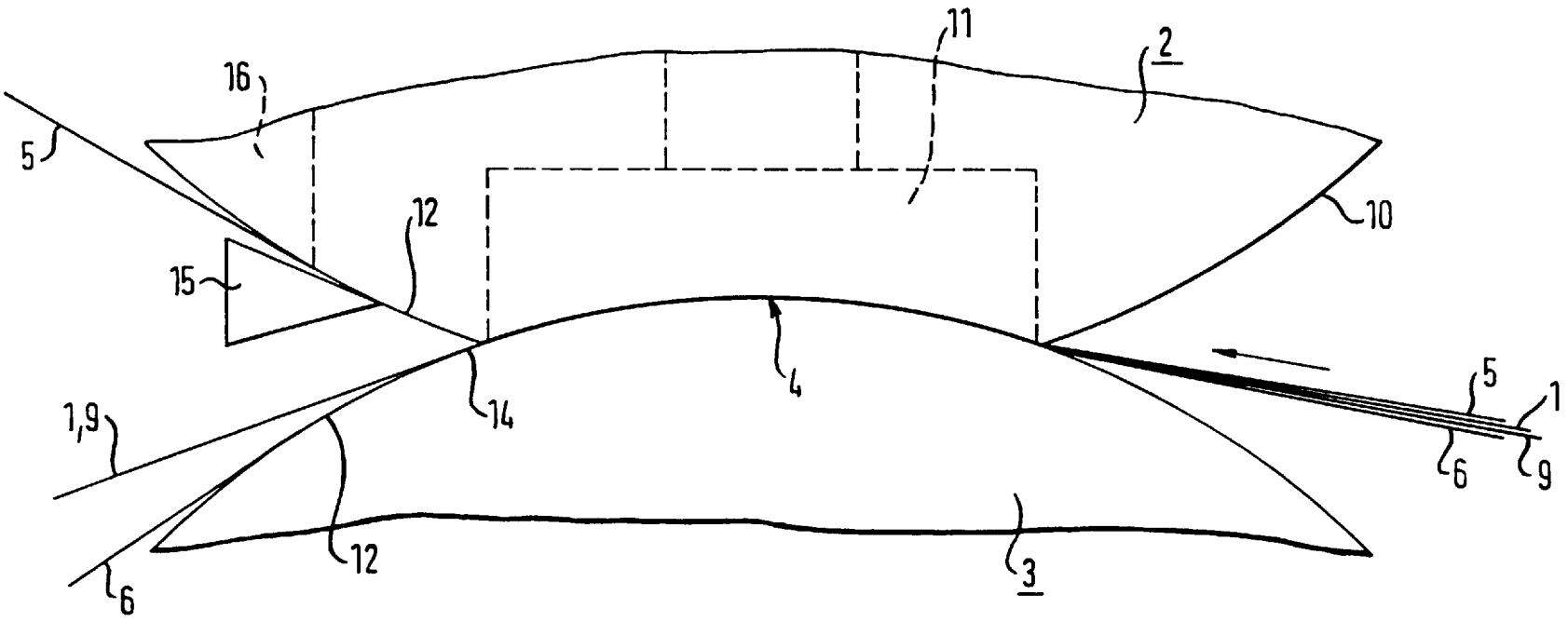
FIG. 6 is a schematic side view of the press gap of the press shown in FIGS. 3 to 5.

In the suction zone 14 the sucking off of liquid during the relaxation of the lower dewatering band 6 takes place through the separating screen 9. Thereafter, as is shown in FIG. 6, the dewatering band 6 is removed from the separating screen 9, which runs jointly with the fiber material web 1 by guiding it along the press element 3. In order to improve the adhesion of the fiber material web 1 to the separating screen 9 in this embodiment the tensioning force of the separating screen 9 at the press gap outlet can preferably be made adjustable in the running direction of the web.

The suction zone 14 can be variably designed in all embodiments with respect to its extent in the web running direction so that a reverse moistening from the dewatering band 6 is precluded. This is possible by a change of the run of the fiber material web 1 after the press gap 4 via a positional change of the corresponding guide roll and via the adjustable longitudinal tension in the separating screen 9.

Since, in accordance with FIG. 6 and further illustrated embodiments, the fiber material web 1 remains in contact with the dewatering band 6 of the cylindrical press element 3 in the suction zone 14, the dewatering in the press gap 4 should predominantly take place towards the other press element 2, which can, for example, be achieved in that the concave press element 2 has a grooved or blind drilled surface and the cylindrical press element 3 has a smooth surface.

For the guidance or separation of the fiber material web 1 it is recommended to use a scraper 15 at the press element 2, 3 or at the dewatering band 5, 6 on which the fiber material web should not stick. Should the press element 2, 3 have a broader pressing surface 4 then the scraper 15 should be arranged in a region of the flexible roll jacket 10 in which the latter is not supported via a sliding bearing 16. This makes careful scraping possible, since the scraper 15 can at least slightly depress the roll jacket 10 against the air overpressure prevailing in the roll jacket and can thus be particularly effective.

In order to promote the separation of the fiber material web from the press element provided with this scraper or from the dewatering band, it is recommended to blow air directly or indirectly into the press gap outlet from the scraper. This assists in guiding the fiber material web in the correct direction at the same time as it leaves the pressing gap 4; moreover, the depression which arises at every press gap outlet is avoided.

Figure 5:
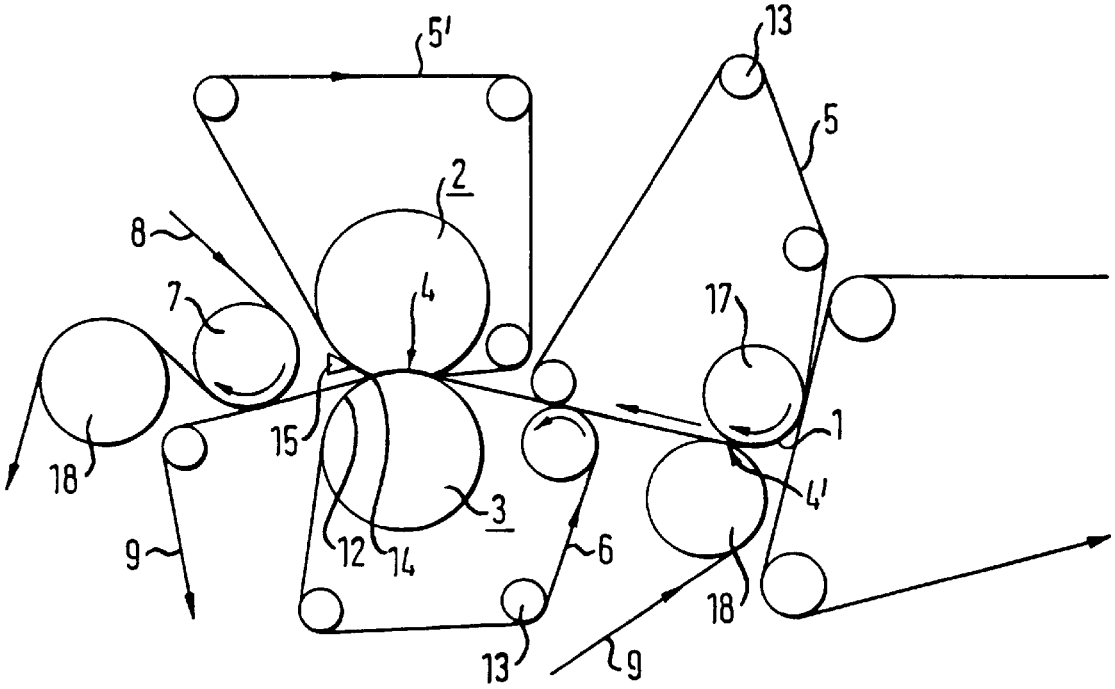
FIG. 5 is the press shown in FIG. 4 with different dewatering bands in the two presses.

As shown in the FIGS. 4 and 5 a further pressing device 17, 18, through which the fiber material web 1 runs, can be inserted before the press 2, 3. In this case the separating screen 9 also runs through the press gap 4' of this preceding pressing device 17, 18 in order to transport the fiber material web 1 in a simple manner from the pressing device 17, 18 to the press 2, 3. In an advantageous manner the upper dewatering band 5 is guided, as shown in FIG. 4, through the press gap 4' of the preceding pressing device. It is, however, also possible to use different dewatering bands 5, 5' for the two presses, as is shown in FIG. 5.

Figure 7:
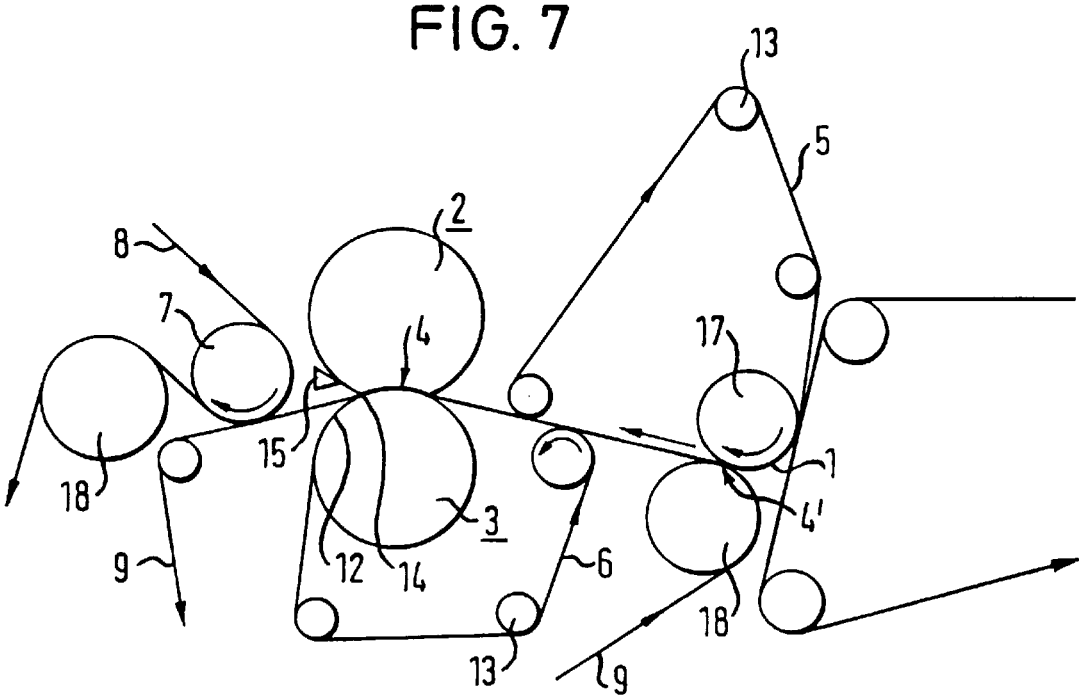
FIG. 7 is a press in accordance with the invention with only one dewatering band, with a further press device preceding it.
Figure 8:
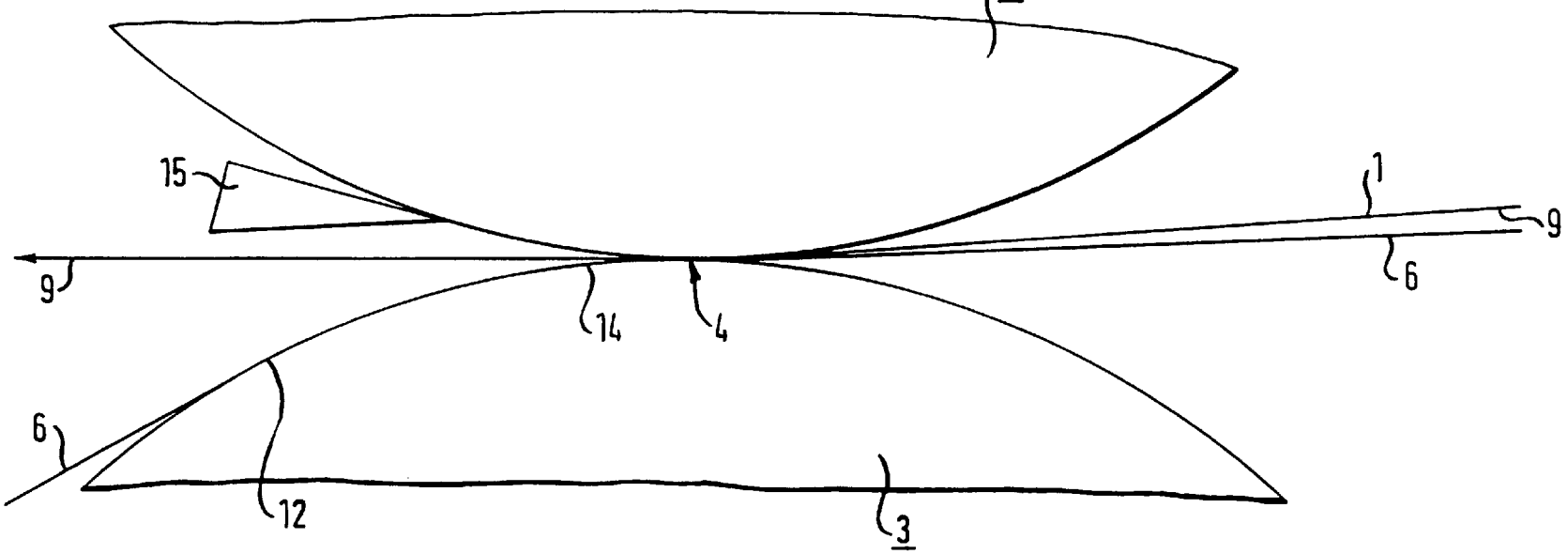
FIG. 8 is the press gap of the press illustrated in FIG. 7, shown in a schematic partial view.

The FIGS. 7 and 8 show the press of FIG. 5 with the provision that a dewatering band 6 is only provided at the lower side of the separating screen 9, and the upper side of the fiber material web 1 lies directly against the press element 2. In this case the cover of the press element 2, which comes directly into contact with the fiber material web 1, consists of a material which repels the fiber material web, in particular of peeler rubber, in order to ensure easy separation of the fiber material web 1 from the press 1 or 2 on departing from the press gap 4.

What is claimed is:

1. A press for dewatering a continuously conveyed fiber material web (1), comprising:

two press elements (2, 3) on opposite sides of the continuously conveyed fiber material web (1) having pressing surfaces, the pressing surfaces pressed toward one another from opposite sides of the continuously conveyed fiber material web (1) to form a press gap (4) through which the continuously conveyed fiber material web is (1) passed to a press gap outlet;

at least one dewatering band (5, 6), the continuously conveyed fiber material web (1) being guided together with the at least one dewatering band (5, 6) through the press gap (4) and thereafter being separated from the continuously conveyed fiber material web (1) in a region following the press gap outlet;

a first one (2) of the two press elements (2, 3) having a grooved or blind bored surface and a second one of the two press elements (3) having a smooth and closed surface, so that the dewatering of the continuously conveyed fiber material web (1) in the press gap (4) predominantly takes place towards the first one of the two press elements (2);

means for separating the continuously conveyed fiber material web (1) from the first one of the two press elements (2) at the press gap outlet;

means for guiding the continuously conveyed fiber material web and the at least one dewatering band (5, 6) in a section (12) following the press gap outlet over an angular range of the second press element of the two press elements (3) after separation from the first one of the two press elements;

means for providing a relaxation of the at least one dewatering band (6) leaving the press gap outlet so that at least one of the properties of thickness, elasticity, and absorbency of the at least one dewatering band (5, 6) provides a short suction zone (14) following the press gap outlet; and, the continuously conveyed fiber material web (1) being separated from the one dewatering band (5, 6) immediately following the suction zone (14).

2. A press for dewatering a continuously conveyed fiber material web (1) according to claim 1 and further comprising:

support means arranged adjacent to the press gap (4) to support the continuously conveyed fiber material web (1) to prevent fluttering and tearing of the fiber material web.

3. A press for dewatering a continuously conveyed fiber material web (1) according to claim 1 and further comprising:

a guide roll (7);

a subsequent unit for processing the continuously conveyed fiber material web (1); and, a support band (8) provided on which the continuously conveyed fiber material web (1) is guided from a guide roll (7) to a subsequent unit.

4. A press for dewatering a continuously conveyed fiber material web (1) according to claim 1 and further comprising:

a separating screen (9) having a low liquid storage capacity;

means for guiding the separating screen through the press gap (4) on at least one side of the fiber material web (1) between the dewatering band (6) and the fiber material web (1) to support the continuously conveyed fiber material web (1) over a path after leaving the press gap (4).

5. A press for dewatering a continuously conveyed fiber material web (1) according to claim 4 and further comprising:

the continuously conveyed fiber material web (1) being guided on the separating screen (9) to a subsequent unit beneath the fiber material web (1).

6. A press for dewatering a continuously conveyed fiber material web (1) according to claim 1 and further comprising:

one of the press elements (2) having a broad, concavely shaped press surface for forming a press gap of a longitudinal extent with the other press element (3), said one of the press elements (2) having a roll jacket (10) consisting of a flexible material, which moves around a carrier; and, the other press element (3) having a pressing surface of complementary shape to the broad, concavely shaped press surface and being formed by a rotating cylindrical roll.

7. A press for dewatering a continuously conveyed fiber material web (1) according to claim 1 and further comprising:

a scraper (15) associated with at least one side of the continuously conveyed fiber material web (1) in order to release the fiber material web (1) from an element (2, 3, 5 or 6) which it contacts after leaving the press gap.

8. A press for dewatering a continuously conveyed fiber material web (1) according to claim 7 and further comprising:

the scraper (15) contacting said first one of the two press elements, (2) said first press element having a broad, concave pressing surface, with the first press element (2) having a flexible roll jacket (10), which is supported via at least one support element (11) on a carrier; and, the scraper (15) coming between the support element (11) and a sliding bearing (16).

9. A press for dewatering a continuously conveyed fiber material web (1) according to claim 1 and further comprising:

means for blowing air to assist the separation of the continuously conveyed fiber material web (1) from a further element (2, 3, 5, 6) brought into the press gap (4) against the direction of web movement.

10. A press for dewatering a continuously conveyed fiber material web (1) according to claim 9 and further comprising:

a scraper (15) serving as an air distributor and air nozzle for the air blowing means.

11. A press for dewatering a continuously conveyed fiber material web (1) according to claim 7 and further comprising:

the scraper (15) serving as a carrier for a corresponding air nozzle.

12. A press for dewatering a continuously conveyed fiber material web (1) according to claim 4 and further comprising:

means for adjusting a tensioning force of the separating screen (9) at the press gap outlet in a direction of web movement in order to improve sticking of the continuously conveyed fiber material web (1) to the separating screen (9).

13. A press for dewatering a continuously conveyed fiber material web (1) according to claim 1 and further comprising:

two dewatering bands arranged on either side of the continuously conveyed fiber material web (1);

means for conveying the fiber material web (1) guided between two dewatering bands (5, 6) through the press gap (4); and the thickness, elasticity, and/or the absorbency of the dewatering band (5, 6) at the side of the fiber material web (1) on which the fiber material web (1) is to be moved along by the dewatering band (5, 6) being greater than the absorbency of the dewatering band (5, 6) at the opposite side of the fiber material web (1).

14. A press for dewatering a continuously conveyed fiber material web (1) according to claim 1 and further comprising:

a coating of the first press elements (2), coming directly into contact with the continuously conveyed fiber material web (1) and consisting of a material which repels the fiber material web.

15. A press for dewatering a continuously conveyed fiber material web (1) according to claim 1 and further comprising:

the one dewatering band (5, 6) being guided prior to moving through the press gap (4) to at least one preceding press device (17, 19), with at least one of the press elements of the at least one further press device being a suction roll.

16. A press for dewatering a continuously conveyed fiber material web (1) according to claim 1 and further comprising:

a separating screen (9) which is guided prior to moving through the press gap (4) to at least one preceding press device (17, 19), with at least one of the press elements of the at least one preceding pressing device being a suction roll.

* * * * *